US007134841B2

(12) United States Patent
Montgomery

(10) Patent No.: US 7,134,841 B2
(45) Date of Patent: Nov. 14, 2006

(54) DEVICE FOR OPTIMIZING AND ADJUSTMENT OF STEAM BALANCE HOLE AREA

(75) Inventor: Michael Earl Montgomery, Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 181 days.

(21) Appl. No.: 10/986,285

(22) Filed: Nov. 12, 2004

(65) Prior Publication Data

US 2006/0104811 A1 May 18, 2006

(51) Int. Cl.
*F01D 5/18* (2006.01)
*F01D 5/08* (2006.01)

(52) U.S. Cl. ..... 416/91; 416/96 R; 416/1

(58) Field of Classification Search ..... 416/1, 416/91, 96 R, 244 B, 245 A
See application file for complete search history.

(56) References Cited

U.S. PATENT DOCUMENTS 3,668,968 A * 6/1972 Modrey ..... 411/74
3,865,497 A * 2/1975 Bratt et al. ..... 403/15
6,364,613 B1 4/2002 Deallenbach et al.
6,773,227 B1 8/2004 Montgomery

* cited by examiner

*Primary Examiner*—Edward K. Look
*Assistant Examiner*—Dwayne J White
(74) *Attorney, Agent, or Firm*—Nixon & Vanderhye P.C.

(57) ABSTRACT

A hole diameter adjustment device for changing an existing diameter of a hole formed in a component to a smaller desired diameter includes an outer sleeve adapted for insertion within the existing hole, the first outer sleeve having an inner bore including a first tapered portion and an axially aligned first threaded portion; and an inner sleeve adapted for insertion within the outer sleeve, the inner sleeve having a tapered outer surface adapted to engage the first tapered portion of the outer sleeve, and an axially aligned second threaded portion adapted to engage the first threaded portion, the second sleeve formed with an internal bore of the smaller desired diameter.

12 Claims, 2 Drawing Sheets

DEVICE FOR OPTIMIZING AND ADJUSTMENT OF STEAM BALANCE HOLE AREA

BACKGROUND OF THE INVENTION

This invention relates to a steam turbine and, more particularly, to a device that enables adjustment and optimization of turbine wheel steam balance hole area for existing wheel steam balance holes in retrofit applications to facilitate reuse of an existing rotor.

Steam balance holes are used to optimize the flow and performance of steam turbine stages. Generally, a plurality of steam balance holes are used to pass leakage flows across the turbine wheel to minimize the disruption of the main stage flow and/or to provide cooling to the wheel. For a typical stage, if the total hole area is too small, steam will enter the main steam flow path between a rotating blade and the stationary blade. This intrusion flow disrupts the main flow and causes losses that are detrimental to stage performance. If, on the other hand, the total steam balance of the hole area is too large, flow is sucked from the main steam path, thereby decreasing the work generated by the stage.

In retrofit applications, where the steam path (rotating and stationary blades) is being replaced, the rotor (including the turbine wheels and shaft) is often the most expensive component, and often takes the longest to produce. The on-going development of brush seals to seal the shaft leakage and the optimization of radial clearances has generally caused a reduction in the required steam balance hole area. As a result, in a retrofit situation, the steam balance hole area is usually far greater than required for optimum stage performance, and therefore, the advantage of modern leakage control may not be fully realized. The requirement for a smaller steam balance hole area, coupled with the economic advantage of reusing the existing rotor, indicates the need for a device to adjust and optimize the existing wheel steam balance hole area during a steam path retrofit.

BRIEF DESCRIPTION OF THE INVENTION

The present invention relates to a relatively simple device that enables adjustment and optimization of the wheel steam balance hole area for existing balance holes, primarily for retrofit applications.

In the exemplary embodiment, the hole area adjustment device is comprised of two parts, a tapered flexible outer sleeve and a tapered inner sleeve. The taper is used to provide wedging action that secures the device within an existing steam balance hole. Accordingly, the outer sleeve must be sufficiently flexible to comply with the wedging action applied by the insertion of the tapered inner sleeve and the existing wheel steam balance hole. The outside diameter of the outer sleeve is sized to fit the existing wheel steam balance hole diameter, while the inside diameter of the inner sleeve is sized to provide the optimum steam balance hole area for the new stage components.

Both the outer sleeve and inner sleeve are threaded at downstream ends. The outer sleeve may be provided with spanner holes on its downstream end while the inner sleeve may be provided with spanner holes on its upstream end. These spanner holes are used to tighten the inner sleeve within the outer sleeve. Of course, the spanner holes may be replaced by any other suitable alternative configuration.

In a typical installation, the outer sleeve is inserted into the existing wheel steam balance hole from one side of the wheel. Its axial position is adjusted so that when both sleeves are fully inserted, neither will protrude past the wheel faces. The inner sleeve is subsequently inserted into the outer sleeve from the opposite side of the wheel sleeve, and the threads of the inner and outer sleeves are engaged. Spanners are temporarily inserted into both parts so that torque may be applied to obtain the expansion of the outer sleeve necessary to secure the device within the existing steam balance hole. Once the desired torque has been applied, one or both ends of the assembled parts are secured to one another by, for example, peening, grub screw or other similar device. This process is repeated for each of the steam balance holes in the rotor wheel, such that the sum of the individual steam balance hole areas matches the required total steam balance hole area.

Accordingly, in its broader aspects, the present invention relates to a hole diameter adjustment device for changing an existing diameter of a hole formed in a component to a smaller desired diameter comprising an outer sleeve adapted for insertion within the existing hole, the first outer sleeve having an inner bore including a first tapered portion and an axially aligned first threaded portion; and an inner sleeve adapted for insertion within the outer sleeve, the inner sleeve having a tapered outer surface adapted to engage the first tapered portion of the outer sleeve, and an axially aligned second threaded portion adapted to engage the first threaded portion, the inner sleeve formed with an internal bore of the smaller desired diameter.

In another aspect, the invention relates to a turbine rotor wheel with a plurality of steam balance holes arranged in an annular array about a centerline of the wheel, at least some of the steam balance holes fitted with a hole diameter adjustment device comprising an outer sleeve having an inner bore including a first tapered portion and an axially aligned first threaded portion; and an inner sleeve inserted within the outer sleeve, the inner sleeve having a tapered outer surface engaged with the first tapered portion of the outer sleeve, and an axially aligned second threaded portion engaged with the first threaded portion, the inner sleeve formed with an internal bore of a smaller desired diameter.

In still another aspect, the invention relates to a method of adjusting total steam balance hole area in a stage of a turbine rotor formed with a plurality of steam balance holes, a sum of hole areas of the steam balance holes representing the total steam balance hole area, the method comprising (a) determining an optimized total steam balance hole area; and (b) adjusting the hole areas of each of the steam balance holes to achieve the optimized total steam balance hole area by inserting into each steam balance hole a two-piece adjustment device including inner and outer sleeves, the inner sleeve formed with an internal bore sized such that a sum of the internal bore areas of all of the adjustment devices equals the total steam balance hole area.

The invention will now be described in detail in connection with the drawings identified below.

DETAILED DESCRIPTION OF THE INVENTION

Figure 1:
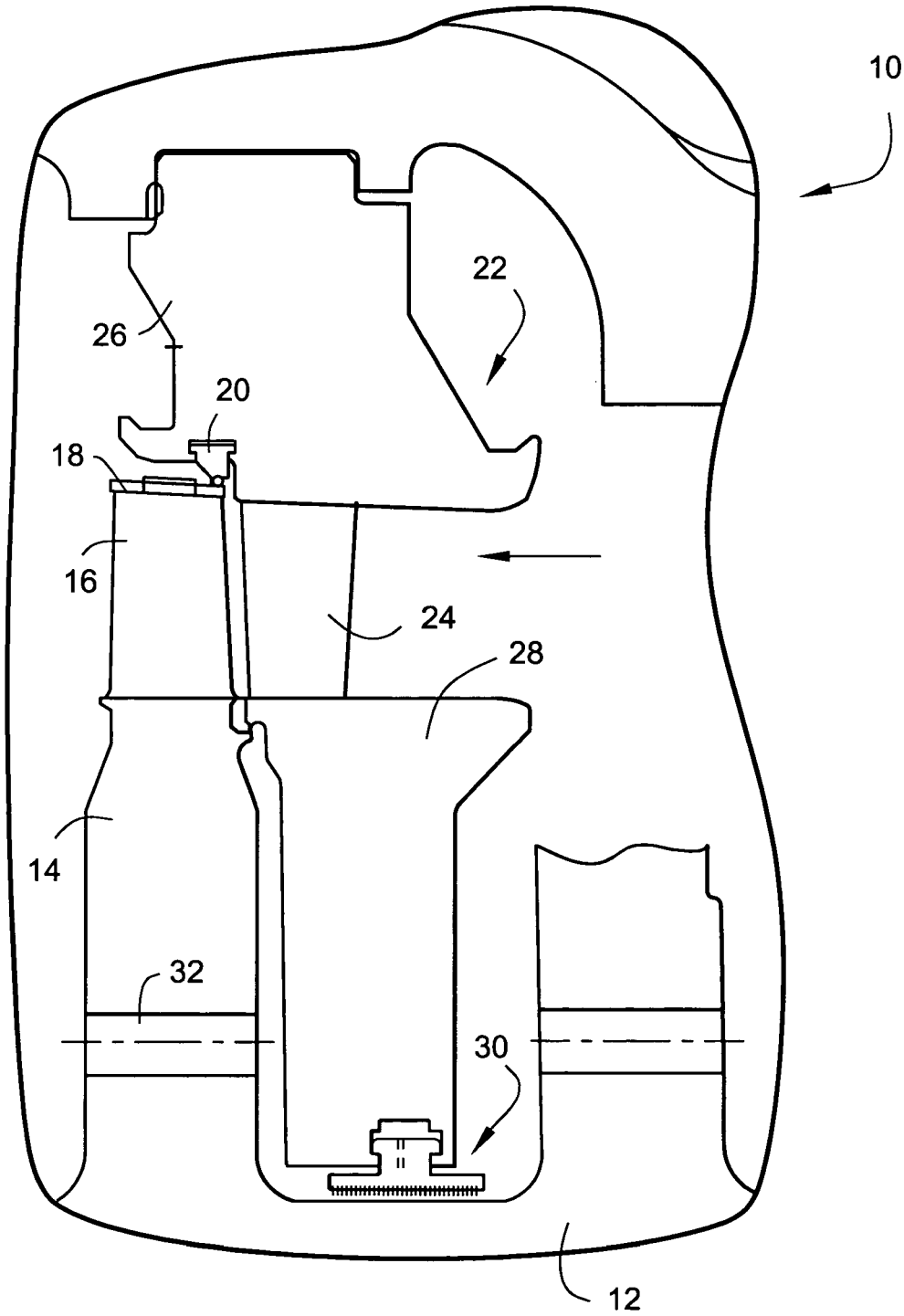
Fig. 1 (PRIOR ART)
FIG. 1 is an elevation view of a portion of a steam turbine stage.

With reference to FIG. 1, a typical turbine stage 10 includes a rotor 12 formed with a plurality of wheels, one shown at 14. The wheel mounts a plurality of circumferentially spaced buckets 16. A shroud cover 18 at the radially outer tip of the bucket 16 cooperates with a seal ring 20 in the stationary diaphragm 22 to prevent main flow leakage across the tip of the bucket. A plurality of circumferentially spaced, stationary nozzles 24 are fixed between the outer ring 26 and inner web 28 of the diaphragm, upstream of the buckets 16. A brush seal or packing ring 30 is mounted in the inner web 28, extending radially inwardly toward the rotor 12 to minimize leakage between the rotor and the diaphragm.

Figure 2:
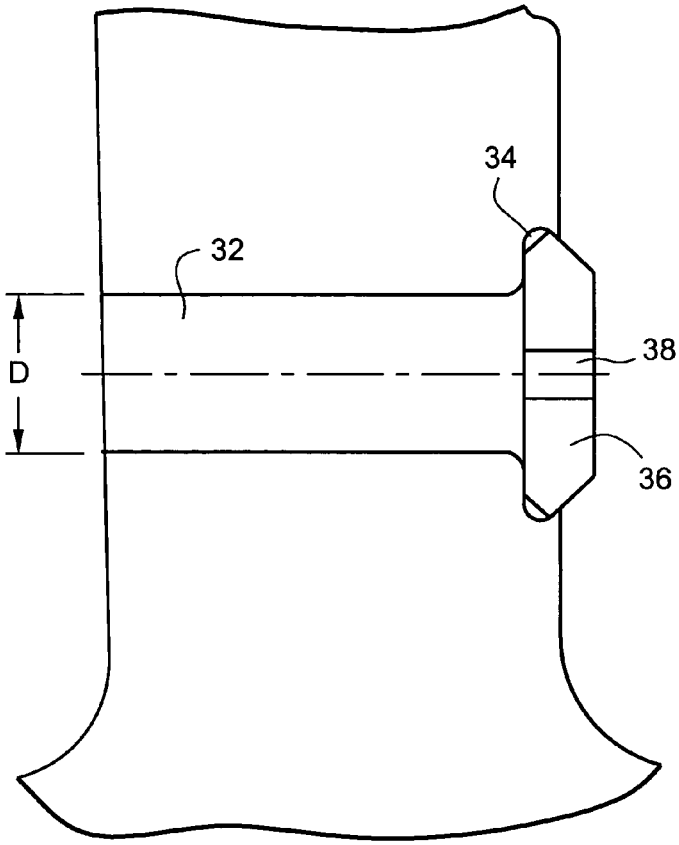
Fig. 2 (PRIOR ART)
FIG. 2 is a cross section illustrating a typical wheel steam balance hole, but with a conventional end plate for adjusting the steam balance hole inlet.

The wheel 14 is also provided with a plurality of axial steam balance holes 32 (one shown), that are used to pass leakage flows across the turbine wheel, as described further below. FIG. 2 is an enlargement of the steam balance hole 32. Typically, a quantity N of round holes 32 with a specified diameter D are drilled at a specified radius from the rotor centerline, and the holes are equally circumferentially spaced about the wheel. The specific number of holes 32 (typically between 5 and 9) and their diameters D are selected during the design of the original steam path, and the diameters D are chosen typically to produce a total steam balance hole area of about 3.750 to 20.250 sq. in.

Main steam is expanded through the stationary nozzles 24 to provide acceptable velocity at the discharge to the rotating buckets 16 to efficiently use the steam to produce useful work. Typically, steam leaks across the stationary nozzles 24 at the packing ring or brush seal 30. This leakage steam has two potential paths: (1) through the wheel steam balance hole 32 or (2) into the space between the stationary nozzles 24 and rotating buckets 16. For an optimized steam hole balance area, the leakage steam will flow through the balance hole. If, however, the area of hole 32 is too small, leakage steam will continue radially outwardly and enter the main steam path between the nozzles 24 and buckets 16. If the area of hole 32 is too large, steam may be sucked radially inwardly from the main steam path toward and into the wheel steam balance hole.

One known prior hole adjustment technique is also shown in FIG. 2. In some instances, dynamic balancing provisions are supplied on the wheel face for adding balance weights to adjust rotor residual imbalance. In locations where dynamic balance grooves 34 (which may be of typical dovetail design) exist and are in line with the steam balance hole 32, a plate 36 has been secured over the hole 32 and a smaller hole 38 of optimum diameter (hence area) drilled through the plate to provide optimum area for the new stage. However, this balance groove geometry may only exist for the first and last stages of the turbine section, so its utility is limited to those stages. Machining of grooves 34 in existing wheels is undesirable in that it increases stress in these critical components.

Figure 3:
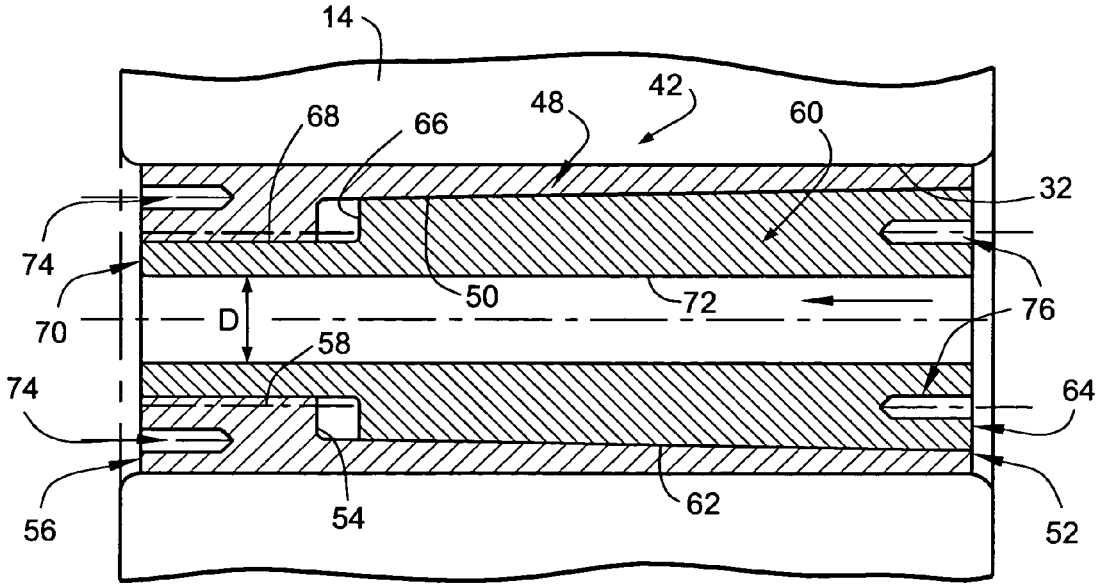
FIG. 3 is a cross section of a steam balance hole incorporating a device in accordance with an exemplary embodiment of the invention.

Turning now to FIG. 3, an adjustment device 42 in accordance with an exemplary embodiment of this invention is shown fully inserted within a steam balance hole 32 in the rotor wheel 14. The device 42 includes a first substantially cylindrical outer sleeve 48 with a first inner bore 50 that tapers inwardly in the direction of flow from an upstream end 52 of the sleeve to a shoulder 54 proximate the downstream end 56. A threaded, uniform diameter bore 58 extends from the shoulder 54 to the downstream end 56. As will be understood, the threaded portion of the device could use straight threads (uniform diameter) or tapered threads (tapered thread diameter).

A second, or inner sleeve 60, is tapered inwardly along its outer surface 62, the taper angle matched to the tapered inner bore 50 of the outer sleeve. The taper extends axially, also in the direction of flow, from the upstream end 64 to an annular radial shoulder 66. External threads are provided on a cylindrical portion 68 extending from the shoulder 66 to the downstream end 70 of the inner sleeve. A uniform diameter bore 72 extends through the inner sleeve, and the inside diameter D (or simply ID) is chosen to optimize steam leakage flow through the wheel 14. For example, if there are 7 steam balance holes in the rotor wheel, and if the total steam balance hole area has been determined to be 0.750 square inches to produce optimum results, then the ID of hole or bore 72 is approximately 0.369 inch. Of course, the diameter of bore 72 will vary as required.

As will be appreciated by those skilled in the art, mechanical balance of the wheel would have to be maintained. Thus, if a device 42 were placed in one steam balance hole, adequate mass would have to be properly placed to balance the added mass of device 42. This requirement does not limit application of the device to all of the existing holes but does introduce an additional mechanical constraint. Another approach would be to use a shorter (lighter) device without a bore in some holes to mechanically balance the devices with bores in the other holes.

Installation of the steam balance hole adjustment device is as follows.

Initially, the outer sleeve 48 is pressed into the existing steam balance hole 32 and preferably inserted from the left side of the wheel as shown in FIG. 3. The axial position of the sleeve 48 is adjusted so that when the assembly is completed, neither the inner nor the outer sleeve will protrude past the wheel faces.

The inner sleeve 60 is then inserted into the outer sleeve from the opposite side of the wheel and the threads 58 and 68 are engaged. Spanners, not shown, are temporarily inserted into both parts, utilizing the spanner blind bores or recesses 74 in the outer sleeve and 76 in the inner sleeve as tool anchors so that the torque required to obtain the necessary expansion of the outer sleeve 48 within the existing steam balance hole 32 may be applied. Once the desired torque has been applied, one or both ends of the assembled sleeves 48, 60 will be secured to one another by any conventional securing technique such as peening, grub screw or other similar device. Note that the opposed shoulders 54, 66 do not engage, i.e., an annular gap remains between them, when the inner sleeve 60 is fully inserted within outer sleeve 48 and properly torqued. It will also be appreciated that the inside diameter of the existing steam balance may be machined to a larger diameter if necessary to accommodate a larger device with a larger outside diameter, provided that wheel stresses and ligaments are acceptable.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A hole diameter adjustment device for changing an existing diameter of a hole formed in a component to a smaller desired diameter comprising:

an outer sleeve adapted for insertion within the existing hole, said first outer sleeve having an inner bore including a tapered portion and an axially aligned first threaded portion; and an inner sleeve adapted for insertion within the outer sleeve, the inner sleeve having a second tapered portion adapted to engage said first tapered portion of said outer sleeve, and an axially aligned second threaded portion adapted to engage said first threaded portion, said inner sleeve formed with an internal bore of the smaller desired diameter.

2. The hole adjustment device of claim 1 wherein, when assembled, said outer and inner sleeves have opposed shoulders located where said tapered portions transition to said first and second threaded portions, respectively.

3. The hole adjustment device of claim 1 wherein one end of said outer sleeve and an opposite end of said inner sleeve are provided with tool engaging recesses.

4. The hole adjustment device of claim 1 wherein said internal bore in said inner sleeve has a diameter of between about 0.3 to 0.5 inch.

5. The hole adjustment device of claim 2 wherein said outer and inner sleeves have substantially the same length dimensions, and wherein, when assembled, a gap remains between said opposed shoulders.

6. A turbine rotor wheel with a plurality of steam balance holes arranged in an annular array about a centerline of the wheel, at least some of the steam balance holes fitted with a hole diameter adjustment device comprising:

an outer sleeve having an inner bore including a first tapered portion and an axially aligned first threaded portion; and an inner sleeve inserted within the outer sleeve, the inner sleeve having a second tapered portion engaged with said first tapered portion of said outer sleeve, and an axially aligned second threaded portion engaged with said first threaded portion, said inner sleeve formed with an internal bore of a smaller desired diameter.

7. The turbine rotor wheel of claim 6 wherein said outer and inner sleeves have opposed shoulders where said tapered portions transition to said first and second threaded portion, respectively.

8. The turbine rotor wheel of claim 6 wherein one end of said outer sleeve and an opposite end of said inner sleeve are provided with tool engaging recesses.

9. The turbine rotor wheel of claim 6 wherein said internal bore in said inner sleeve has a diameter of between about 0.3 to 0.5 inch.

10. The turbine rotor wheel of claim 7 wherein said outer and inner sleeves have substantially the same length dimensions, and wherein a gap remains between said opposed shoulders.

11. A method of adjusting total steam balance hole area in a stage of a turbine rotor formed with a plurality of steam balance holes, a sum of hole areas of said steam balance holes representing the total steam balance hole area, the method comprising:

(a) determining an optimized total steam balance hole area; and (b) adjusting the hole areas of each of the steam balance holes to achieve the optimized total steam balance hole area by inserting into each steam balance hole a two-piece adjustment device including inner and outer sleeves, the inner sleeve formed with an internal bore sized such that a sum of the internal bore areas of all of the adjustment devices equals the total steam balance hole area.

12. The method of claim 11 wherein said outer sleeve has an inner bore including a first tapered portion and an axially aligned first threaded portion; and wherein said inner sleeve is inserted within said outer sleeve, said inner sleeve having a second tapered portion engaged with said first tapered portion of said outer sleeve, and an axially aligned second threaded portion engaged with said first threaded portion.

* * * * *